US006615491B1

(12) United States Patent
Kaizuka

(10) Patent No.: US 6,615,491 B1
(45) Date of Patent: Sep. 9, 2003

(54) ION PROCESSED STYLISH ORNAMENT

(75) Inventor: Kazutoshi Kaizuka, Fukuoka (JP)

(73) Assignee: Create Co., LTD, Fukuoa (JP)

( * ) Notice: Subject to any disclaimer, the term of this patent is extended or adjusted under 35 U.S.C. 154(b) by 0 days.

(21) Appl. No.: 09/685,453

(22) Filed: Oct. 9, 2000

(51) Int. Cl.[7] ..... A44C 27/00

(52) U.S. Cl. ..... 29/896.411; 29/896.4; 427/258

(58) Field of Search ..... 600/9, 15, 300; 601/15, 20, 21; 128/897, 898; 427/258; 29/896.4, 896.41

(56) References Cited

U.S. PATENT DOCUMENTS 5,224,397 A * 7/1993 Yoo
5,531,675 A * 7/1996 Yoo
5,843,005 A * 12/1998 Chubinsky ..... 601/15

OTHER PUBLICATIONS

Bibliographic Data.
Yukie Niwa, et al.: International Journal of Biometeorology, entitled "Electromagnetic Wave Emitting Products and 'Kikoh' Potentiate Human Leukocyte Functions," published 1993.

* cited by examiner

*Primary Examiner*—P. W. Echols
(74) *Attorney, Agent, or Firm*—Squire, Sanders & Dempsey L.L.P.

(57) ABSTRACT

An ornament is provided that is useful in causing negative ions to be generated from the surface, thereby improving the immunity strength, improving psychological stability and bodily functions, improving the discharge of egesta and the function of the respiratory organs, and reducing fatigue of the person wearing the ornament. The ornament includes a plating layer which is formed by mixing a pulverized multiple element mineral powder and a pulverized sandstone powder. The negative ions are always generated, which act on the blood of a human body and put the human body in a state that is slightly inclined towards negative ions, thereby causing the body to be balanced, the metabolism to become activated, and the body to become healthy and resistant to aging.

8 Claims, 1 Drawing Sheet

ION PROCESSED STYLISH ORNAMENT

BACKGROUND OF THE INVENTION

1. Field of the Invention

The present invention relates to personal ornaments having their surfaces plated with a mixture of a multielement mineral power and a sandstone powder. The plated ornaments such as a brooch, a necklace, a pin, a bracelet, an earring, a corsage, a ring, a hair ornament, a wristwatch, a wristwatch band, etc., generate negative ions from their plated surfaces. The negative ions generated, in turn, will have particular utility in bringing out positive health benefits such as improving immunity strength and other bodily functions.

2. Description of Related Art

There exist a wide variety of metal and plastic ornaments, some of which have their surfaces plated. The plating performed on existing ornaments, however, has a limited purpose of beautifying the surface or preventing rust.

The existing technology for plating ornaments does not cause negative ions to be generated from their surfaces, and has no utility in improving health of the persons wearing the ornaments.

In view of the foregoing limitations, it is the object of this invention to provide a plating technology that will cause negative ions to be generated from the plated ornament surface. The negative ions generated by the plated ornament provide positive health benefits to the wearer, including the potential such as the improvement of the immunity system, the improvement of the psychological stability and bodily functions, the improvement of the discharge of egesta and the function of the respiratory organs and the reduction of fatigue.

SUMMARY OF THE INVENTION

In accordance with the teachings of the present invention, an ion processed stylish ornament is provided that is useful in causing negative ions to be generated from the surface, thereby improving the immunity strength, improving psychological stability and bodily functions, improving the discharge of egesta and the function of the respiratory organs, and reducing fatigue, of the person wearing the ornament.

The ornament includes a thin metal film that covers and forms a plating layer on the surface of a formed product composed of metal or plastic. The plating layer is a mixture of a pulverized multielement mineral powder and a pulverized sandstone powder.

Negative ions are always generated from the plating layer on the surface of the ornament. The circulation of blood is improved due to the action of the negative ions, and the improved blood circulation is useful in improving immunity strength, psychological stability and bodily functions, discharge of egesta and the function of the respiratory organs, and reducing fatigue.

A more complete understanding of the ion processed stylish ornament will be afforded to those skilled in the art, as well as a realization of additional advantages and objects thereof, by a consideration of the following detailed description of the preferred embodiments. Reference will be made to the appended sheets of drawings, which will first be described briefly.

DETAILED DESCRIPTION OF THE PREFERRED EMBODIMENTS

The present invention provides an ion processed stylish ornament that is useful in causing negative ions to be generated from a surface coating, thereby improving the immunity strength, improving psychological stability and bodily functions, improving the discharge of egesta and the function of the respiratory organs and reducing fatigue of the person wearing the ornament. In the detailed description that follows, it should be appreciated that like element numerals are used to describe like elements illustrated in one or more of the figures.

Figure 1:
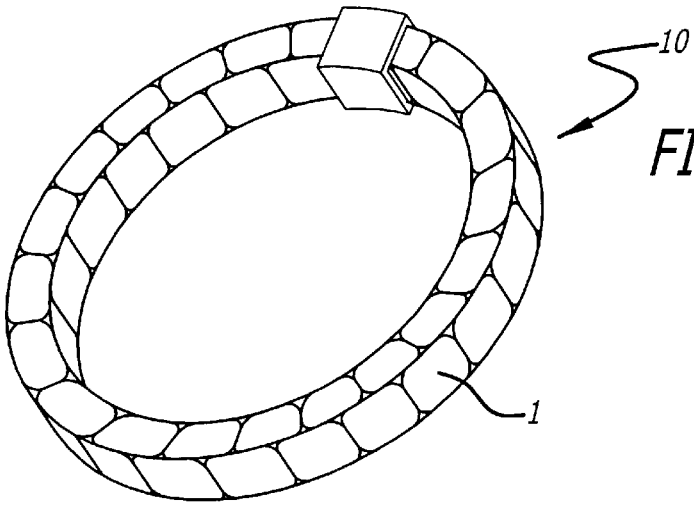
FIG. 1 is a perspective view showing a representative ornament having the plating according to an embodiment of the present application.
Figure 2:
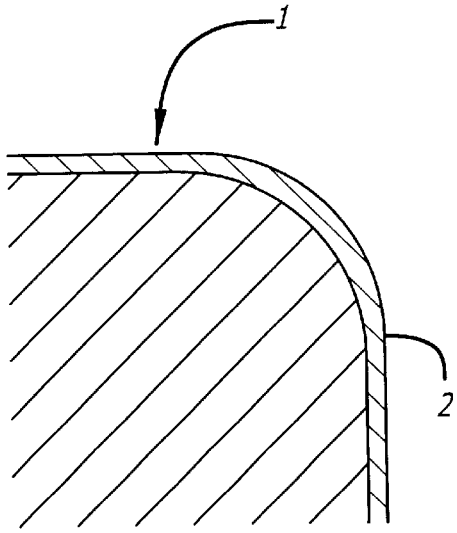
FIG. 2 is a cross-sectional diagram of the ornament of FIG. 1 having the plating according to an embodiment of the present application.

Referring first to FIG. 1, a perspective view showing a representative ornament according to an embodiment of the present application is provided. The ornament 10, which is shown in the form of a necklace, includes a formed part 1 such as a chain and a plating layer 2 formed on its surface, as shown in FIG. 2. The formed part 1 and the plating layer 2 on its surface are regarded as the principal constituents of the ornament. It should be noted that the necklace ornament depicted herein is representative only, and that the concept of the invention may be applied to virtually any type of ornament or jewelry having a surface allowing for plating.

The formed part 1 may be made of brass and is connected and formed into a circle. It should be appreciated that the material of the formed part is not limited to brass, and another metal or alloy, or ABS, nylon resin and noryl resin or plating grade plastic may be used.

The plating layer 2 is formed by carrying out a copper sulfate composition plating as the first coat on the surface of the formed part 1, and, on top of that, carrying out gold plating. It should be appreciated that the first coat is not limited to a copper sulfate composition plating and the top plating is not limited to gold plating. Silver plating and the plating of other metals and alloys are also acceptable. In addition, for the plating method, well-known methods can be appropriately selected, including plastic plating methods.

According to the present invention, the copper sulfate plating composition used for the first coat on the surface is prepared by mixing copper sulfate with a pulverized multielement mineral powder and a pulverized sandstone powder.

The multielement mineral contains multiple elements in a preferable balance, for example, silicon like tourmaline, perlite and pitchstone as main components. In the multielement mineral used in this embodiment, perlite is pulverized to about 1~3 microns with a ball mill or the like. The sandstone is pulverized to about 1~3 microns by a ball mill or the like to form a sandstone powder. It is desirable to use two or more types of multielement mineral powders appropriately mixed together and blended into the copper sulfate.

The perlite may, by way of example, be composed of the following sub-components.

| | |
|---|---|
| Anhydrous silicon ($SiO_2$) | 71.94% |
| Aluminum oxide ($Al_2O_3$) | 14.94% |
| Iron oxide ($Fe_2O_3$) | 2.54% |
| Magnesium oxide (MgO) | 0.44% |

-continued

| | |
|---|---|
| Calcium oxide (CaO) | 2.47% |
| Alkali oxide ($K_2O + Na_2O$) | 6.87% |
| Manganese oxide (MnO) | 0.03% |
| Anhydrous phosphoric acid ($P_2O_5$) | 0.14% |
| Loss on heating | 3.43% |
| Loss on drying (in 110 degrees Celsius (° C.)) | 0.07% |
| Other titanium | Trace |

The selected sandstone, for example, may be composed of the following components.

| | |
|---|---|
| Ig. loss | 3.48% |
| $SiO_2$ | 62.7% |
| $Al_2O_3$ | 18.9% |
| Iron oxide ($Fe_2O_3$) | 5.56% |
| Calcium oxide (CaO) | 2.00% |
| $K_2O$ | 2.32% |

In the foregoing table "Ig. Loss" or ignition loss corresponds to the kaolin cosmetics standard ignition loss (500° C. constant temperature).

For the multielement mineral powder and the sandstone powder, mixing these in the copper sulfate plate composition unchanged as powder bodies is acceptable. Alternatively, the powders may be mixed with water, heated and pressurized, and the resulting solution, which is a clear liquid, can be blended into the copper sulfate. Alternatively, the resulting solution can be again reduced to a powder by vacuum combination drying and spray drying prior to the resulting powder being blended into the copper sulfate.

When mixing a multielement mineral powder and a sandstone powder in the copper sulfate plating composition, one liter of copper sulfate plating liquid is heated up to about 70 degrees Celsius (C.). Then, about 80 g of multielement mineral powder and about 20 g of sandstone powder are put into the heated mixture. After stirring well and mixing together, the mixture is returned to a copper sulfate tank holding about 100 liters. In the tank, a sediment trap, pump, air, or alternative mixing means is provided so that the multielement mineral powder and the sandstone powder do not sink to the bottom.

When plating the ornament 10, the formed parts 1 to be coated are formed to their final shape, for example they can be connected and a circular ornament 10 can be formed. Next, the mixed multielement mineral powder and sandstone powder copper sulfate plating composition is applied as a base plating layer. On top of the copper sulfate plating composition, the gold or other decorative plating is carried out.

Because a pulverized multiple element mineral and a sandstone powder are mixed in the copper sulfate plating layer, negative ions are always generated by the ornament 10, which act on the blood of a human body to influence the human body to a state slightly inclined towards negative ions. The end effect is that the body is balanced, the metabolism becomes activated, the body becomes healthy and also resistant to aging.

Figure 3:
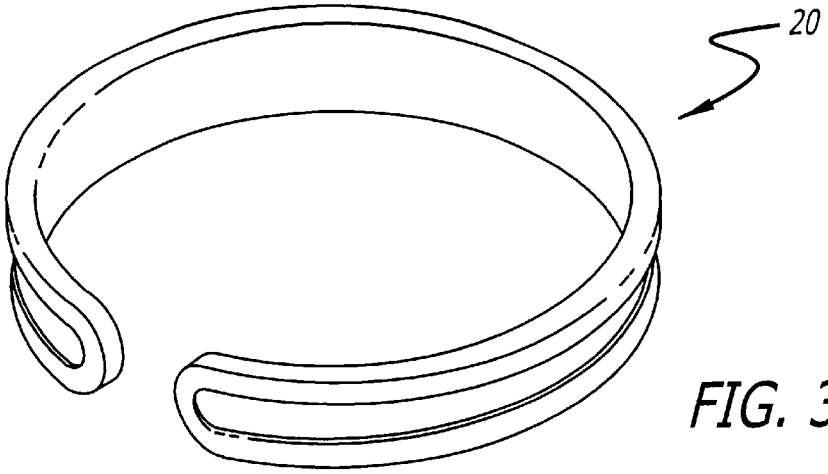
FIG. 3 shows another representative ornament, a bracelet, having the plating according to the present application.

Referring now to FIG. 3, a bracelet (ornament) 20 according to another embodiment of the present application is illustrated. Bracelet 20 is normally worn on the arm by a wearer. Because the material and plating layer, etc., are the same as the above-mentioned embodiment described with respect to FIGS. 1 and 2, and, furthermore, the plating method and the use method or the action are also the same, except for the fact that a bracelet is worn on the arm by a wearer, its explanation is omitted. It should be appreciated that many types of ornaments other than a necklace or a bracelet may be used such as a brooch, a pin, an earring, a corsage, a ring, a hair ornament, a wristwatch, a wristwatch band, etc.

Having thus described the preferred embodiments of an ion processed stylish ornament, it should be apparent to those skilled in the art that certain advantages of the within system have been achieved. It should also be appreciated that various modifications, adaptations, and alternative embodiments thereof may be made within the scope and spirit of the present invention. For example, mixing multiple element mineral powder and sandstone powder in the first plating coat has been illustrated, but it should be apparent that the inventive concepts described above would be equally applicable to mixing multiple element mineral powder and sandstone powder in the plating of the top layer. The invention is further defined by the following claims.

What is claimed is:

1. A method for making an ornament useful in causing negative ions to be generated from a surface of the ornament, the method comprising the steps of:

connecting multiple formed parts to shape an ornament;

mixing a multielement mineral powder and a sandstone powder into a first plating composition coat;

plating said shaped ornament with a first plating composition to substantially cover the surface of the formed parts; and plating said shaped ornament with a second decorative plating coat on top of the first plating coat.

2. The method of claim 1, wherein the step of plating with said first plating coat further comprises mixing said multielement mineral powder and said sandstone powder into a copper sulfate plating composition.

3. The method of claim 1, wherein the second plating step further comprises gold plating.

4. The method of claim 1 further comprising the step of pulverizing a multielement mineral to about 1–3 microns to form said multielement mineral powder.

5. The method of claim 4, wherein the multielement mineral further comprises perlite.

6. The method of claim 1 further comprising the step of pulverizing a sandstone to about 1–3 microns to form the sandstone powder.

7. The method of claim 1, wherein said mixing step further comprises the steps of: heating one liter of the first plating composition to a temperature of about 70 degrees Celsius (C.);

adding about 80 g of said multielement mineral powder and about 20 g of said sandstone powder into the heated mixture;

after stirring well the heated mixture, returning the heated mixture to a larger tank holding about 100 liters of the first plating composition; in the tank, using a sediment trap to keep the multielement mineral powder and the sandstone powder from sinking to the bottom.

8. A method for making an ornament useful in causing negative ions to be generated from a surface of the ornament, the method comprising the steps of:

connecting multiple formed parts to shape the ornament;

adding a first plating coat substantially covering the surface of the formed parts;

mixing a multielement mineral powder and a sandstone powder to form a second plating coat material; and adding that second plating coat material on top of the first plating coat.

* * * * *